US006626149B2

(12) United States Patent
Hlousek

(10) Patent No.: US 6,626,149 B2
(45) Date of Patent: Sep. 30, 2003

(54) INJECTION SYSTEM

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/936,897

(22) PCT Filed: Jan. 13, 2001

(86) PCT No.: PCT/DE01/00119

§ 371 (c)(1),
(2), (4) Date: Dec. 28, 2001

(87) PCT Pub. No.: WO01/53691

PCT Pub. Date: Jul. 26, 2001

(65) Prior Publication Data

US 2002/0134358 A1 Sep. 26, 2002

(30) Foreign Application Priority Data

Jan. 19, 2000 (DE) ..... 100 02 109

(51) Int. Cl.[7] ..... F02M 37/04
(52) U.S. Cl. ..... 123/447; 123/506
(58) Field of Search ..... 123/446, 447, 123/506, 467

(56) References Cited

U.S. PATENT DOCUMENTS

| | | | | |
|---|---|---|---|---|
| 5,463,996 A | * | 11/1995 | Maley | 123/446 |
| 5,535,723 A | * | 7/1996 | Gibson et al. | 123/446 |
| 5,676,114 A | | 10/1997 | Tarr et al. | |
| 5,711,274 A | | 1/1998 | Drummer | |
| 5,819,704 A | * | 10/1998 | Tarr et al. | 123/467 |
| 5,992,359 A | * | 11/1999 | Rose | 123/446 |
| 6,065,450 A | * | 5/2000 | Chen et al. | 123/446 |
| 6,431,148 B1 | | 8/2002 | Guggenbichler et al. | |

FOREIGN PATENT DOCUMENTS

| | | |
|---|---|---|
| EP | 0 957 261 A2 | 11/1999 |
| JP | 09032682 A | 2/1997 |

* cited by examiner

*Primary Examiner*—Thomas N. Moulis
(74) *Attorney, Agent, or Firm*—Ronald E. Greigg

(57) ABSTRACT

In an injection system for an internal combustion engine, having one fuel pump per engine cylinder to be supplied of the engine, the pump being controlled electronically, having an injection nozzle that is provided with a nozzle needle, and having a connecting line between the fuel pump and the injection nozzle, it is an object for the injection course to be freely selectable. To this end, the injection nozzle is provided with an electronically controlled valve, which is capable of controlling the opening of the nozzle needle.

8 Claims, 6 Drawing Sheets

INJECTION SYSTEM

CROSS-REFERENCE TO RELATED APPLICATIONS

This application is a 35 USC 371 application of PCT/DE 01/00119 filed on Jan. 13, 2001.

BACKGROUND OF THE INVENTION

1. Field of the Invention

The invention relates to an injection system for an internal combustion engine, having one fuel pump per engine cylinder to be supplied, which pump is controlled electronically; having an injection nozzle, which is provided with a nozzle needle; and having a connecting line between the fuel pump and the injection nozzle.

2. Description of the Prior Art

Such an injection system is an individual-cylinder system, in which the injection pump is driven by a camshaft, for instance. Upon actuation by a cam, the fuel to be injected is put under pressure in the fuel pump and delivered to the injection nozzle. The onset and end of pumping by the fuel pump can be controlled for instance by means of a slide valve, which in a first state connects the pumping chamber of the pump with a return line, so that fuel pumping does not occur, and in a second state closes the connection to the return line, so that a pressure buildup is possible. In this way, the injection onset and also, via a control of the length of the injection event, the injection quantity as well can be controlled. However, the injection pressure is a function of the rpm of the camshaft that drives the pump. The course of injection and a pre-injection can also be varied only in the pump. This leads to restrictions in terms of the pre-injection quantity and the shaping of the course of injection, as well as unacceptable deviations between the various individual cylinders of the engine.

The object of the invention is thus to refine a known injection system in such a way that not only the injection quantity and the injection onset but also the injection pressure, course of injection, pre-injection, post-injection and multiple injection can be varied in the desired way.

SUMMARY OF THE INVENTION

The injection system of the invention has the advantage that by suitable actuation of the electronically controlled valve at the injection nozzle, the fuel volume furnished by the fuel pump can be injected as desired; additional parameters for controlling the course of injection are furnished, which are independent of the onset and end of pumping by the fuel pump. Unlike conventional systems, in which the nozzle needle has opened automatically as soon as a predetermined pressure is exceeded after the onset of pumping by the fuel pump, and the nozzle needle also closes automatically again as soon as a certain minimum pressure toward the end of pumping is undershot, with the injection system of the invention it is now possible to inject essentially independently of the pumping rate of the fuel pump. It is also possible, for the same fuel pump dimensions, to utilize the entire stroke of the pump and thus enhance the performance of the system for the same dimensions. Another advantage is that only slight modifications compared with the conventional systems are necessary. The previously used injection nozzle must merely be replaced by an electronically regulated injection nozzle.

In comparison with so-called common rail systems, in which a single fuel pump is used to supply a high-pressure collection chamber, from which the fuel is then injected into the individual cylinders, the system of the invention offers greater operating safety, since in the event of later failure of the fuel pump, because of the modular design of the system only the corresponding cylinder of the engine is affected. The course of injection can be controlled variably in the same way as is possible in a common rail system.

BRIEF DESCRIPTION OF THE DRAWINGS

The invention is described in detail herein below with reference to the accompanying drawings in which.

DESCRIPTION OF THE PREFERRED EMBODIMENTS

Figure 1:
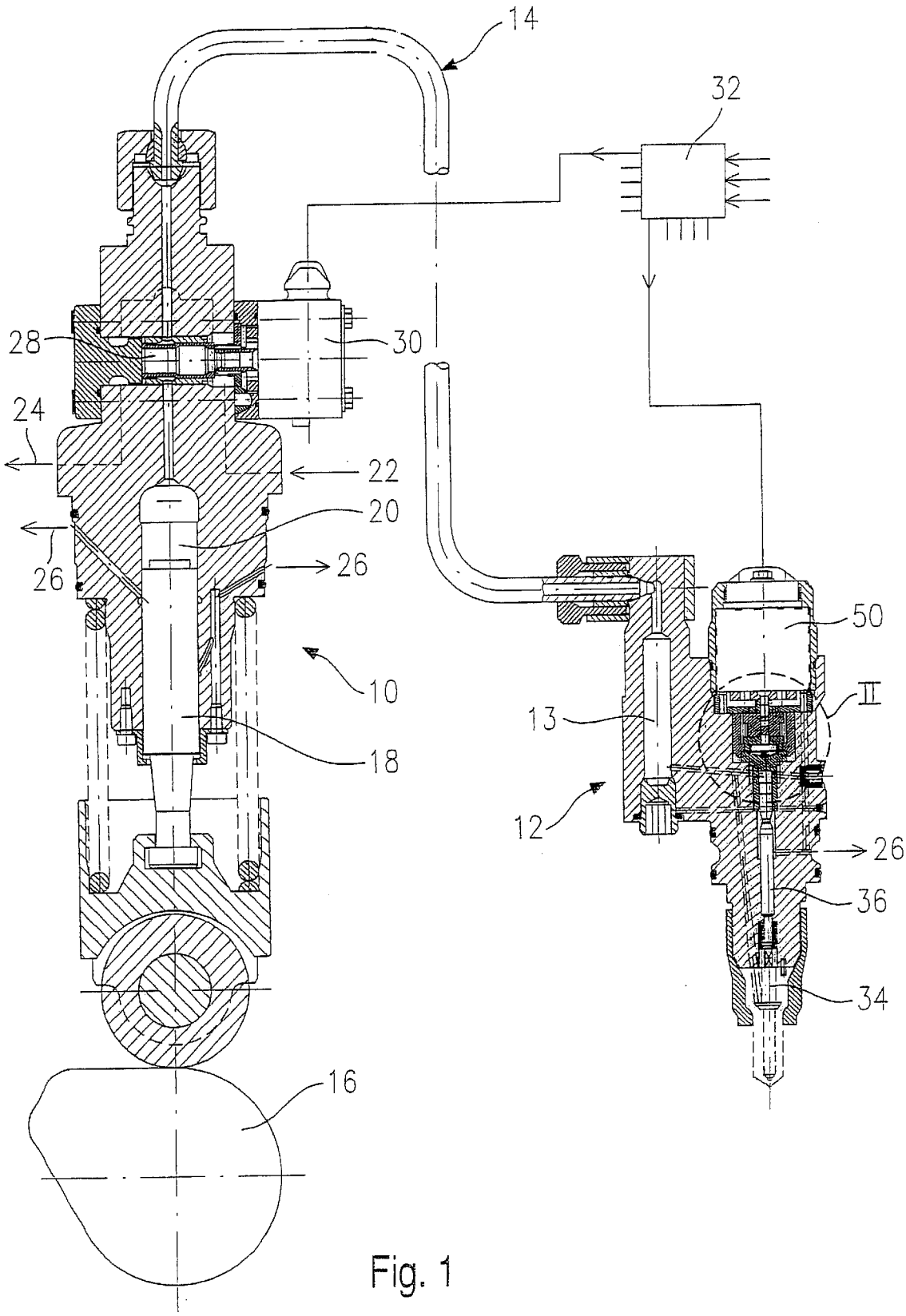
FIG. 1 is a schematic, partially sectional view, of one embodiment an injection system of the invention.

In FIG. 1, an injection system according to the invention is shown in a first embodiment. As its most essential components, it includes a fuel pump 10, an injection nozzle 12, and a connecting line 14 between the fuel pump and the injection nozzle.

The fuel pump 10 is actuated by a rotating cam 16 and has a pump piston 18, which is displaced within a pressure chamber 20. The fuel to be injected is delivered to the fuel pump 10 through a fuel inlet 22, shown schematically. For return to a fuel tank, a fuel return 24 is provided. Neither the low-pressure system formed by the fuel inlet 22 and a prefeed pump for the fuel nor the pressureless return system formed by the fuel return 24 is shown in the drawing. Nor are various leakage returns 26, which can be considered to belong to the fuel return 24, shown in detail.

The fuel pump 10 is provided with a control slide 28, which is actuated by an electronic controlled final control element 30 that communicates with an electronic control unit 32. The control slide 28 can be adjusted, as a function of instructions from the control unit 32, by the final control element 30 between an open position, in which the pressure chamber 20 of the fuel pump communicates with the fuel inlet 22 and the fuel return 24, so that no fuel pumping takes place, and a closed position, in which the communication with the fuel inlet and with the fuel return is closed and a displacement of the pump piston 18 in the pressure chamber 20 causes the fuel located in the pressure chamber 20 to be pumped via the connecting line 14 to the injection nozzle 12.

Figure 2:
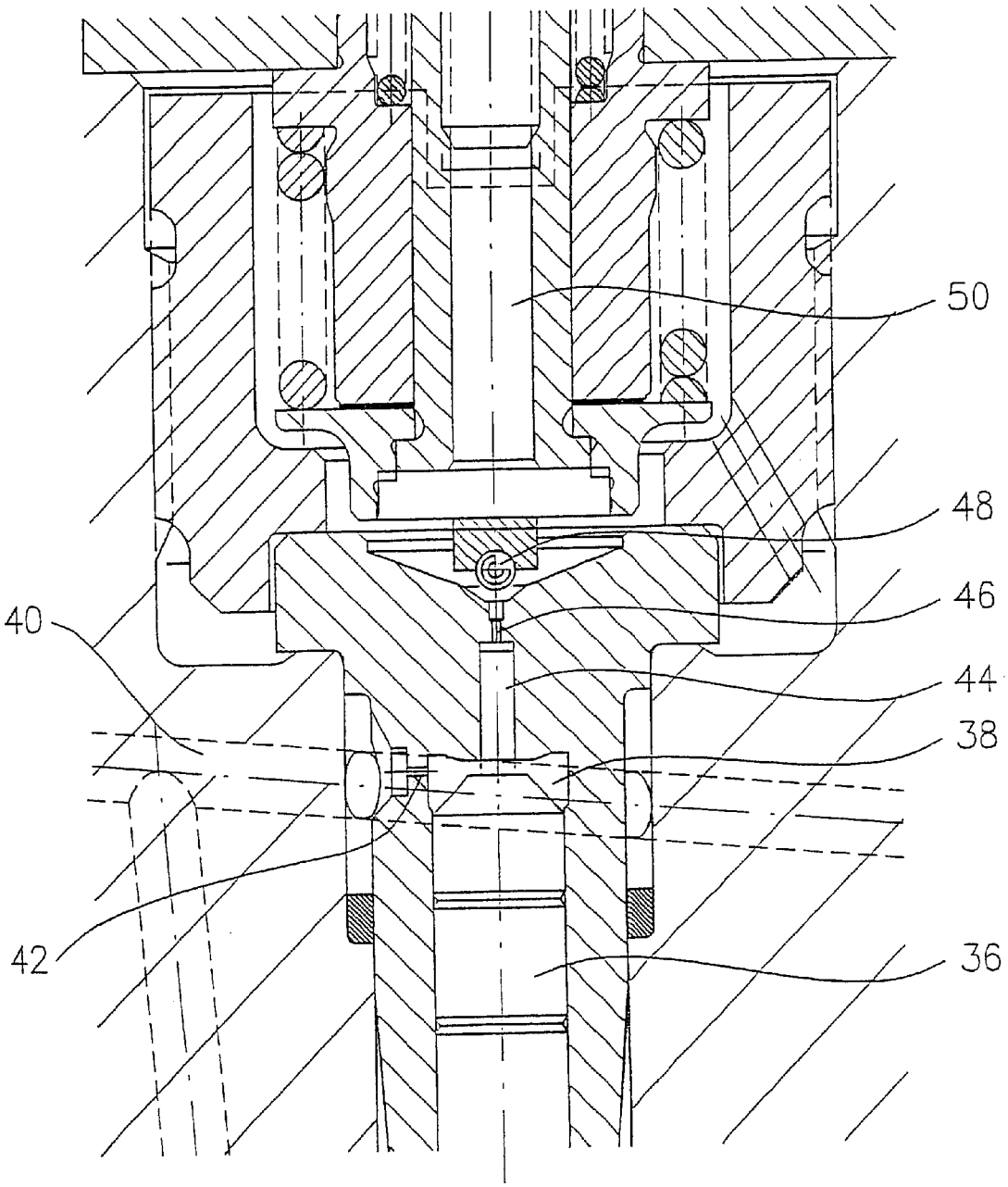
FIG. 2 is detail II of FIG. 1, on a larger scale.

The injection nozzle 12, which is provided with a reservoir 13, has a nozzle needle 34, which is displaceable between a closed position, in which the furnished fuel cannot emerge from the injection nozzle 12, and an opened position, in which the furnished fuel is injected into the cylinder of the engine. The nozzle needle 34 is braced on a thrust rod 36 (see FIG. 2), which closes off a control pressure chamber 38 on one side. The control pressure chamber 38 is provided with an inlet 40, which has an inlet throttle 42, embodied as a bore of small cross section, and an outlet 44, which likewise has an outlet throttle 46 embodied as a bore of small cross section. The cross section of the outlet throttle 46 is larger than the cross section of the inlet throttle 42.

The outlet 44 from the control pressure chamber 38 is controlled by a valve element 48, which is adjustable by a final control element 50, which likewise communicates with the control unit 32, between a position that closes the outlet 44 and a position that opens the outlet 44. When the valve element 48 closes the outlet 44, a fluid delivered via the inlet 40, typically fuel, is dammed up in the control pressure chamber 38. As a result, via the thrust rod 36, a force is exerted on the nozzle needle 34 that keeps the nozzle needle in the closed position, counter to an opening force that is generated by the fuel pressure prevailing at the nozzle needle. Conversely, when the valve element 48 opens the outlet 44, the fluid dammed up in the control pressure chamber 38 can flow out of this chamber, since the outlet throttle 46 has a larger cross section than the inlet throttle 42. Thus no further force is presented counter to a displacement of the thrust rod 36, and the nozzle needle 34 is lifted from its valve seat by the fuel pressure exerted on it, so that the fuel can be injected into the cylinder.

The mode of operation of the injection system described is as follows: The injection event is initiated with the activation of the final control element 30. The final control element displaces the control slide 28 into the position in which the communication between the pressure chamber and both the fuel inlet and the fuel return is closed, so that the fuel pump pumps. As a result, fuel in the connecting line 14 and in the injection nozzle 12 is compressed by the pump piston 18. The nozzle needle 34 remains in its closed position until such time as the desired pressure level is attained; the time between the closure of the control slide 28 and the opening of the nozzle needle 34 thus defines the available injection pressure. When the injection event is to begin, the outlet 44 is opened by the valve element 48, so that the nozzle needle 34 can lift from its valve seat. By means of the actuation of the valve element 48 independently of the control slide 28, a pre-injection, a main injection with an arbitrary course of injection, and a post-injection can be controlled. The various characteristic variables that are relevant to these cases are shown in the graphs in FIGS. 6*a*–6*d*.

Figure 6:
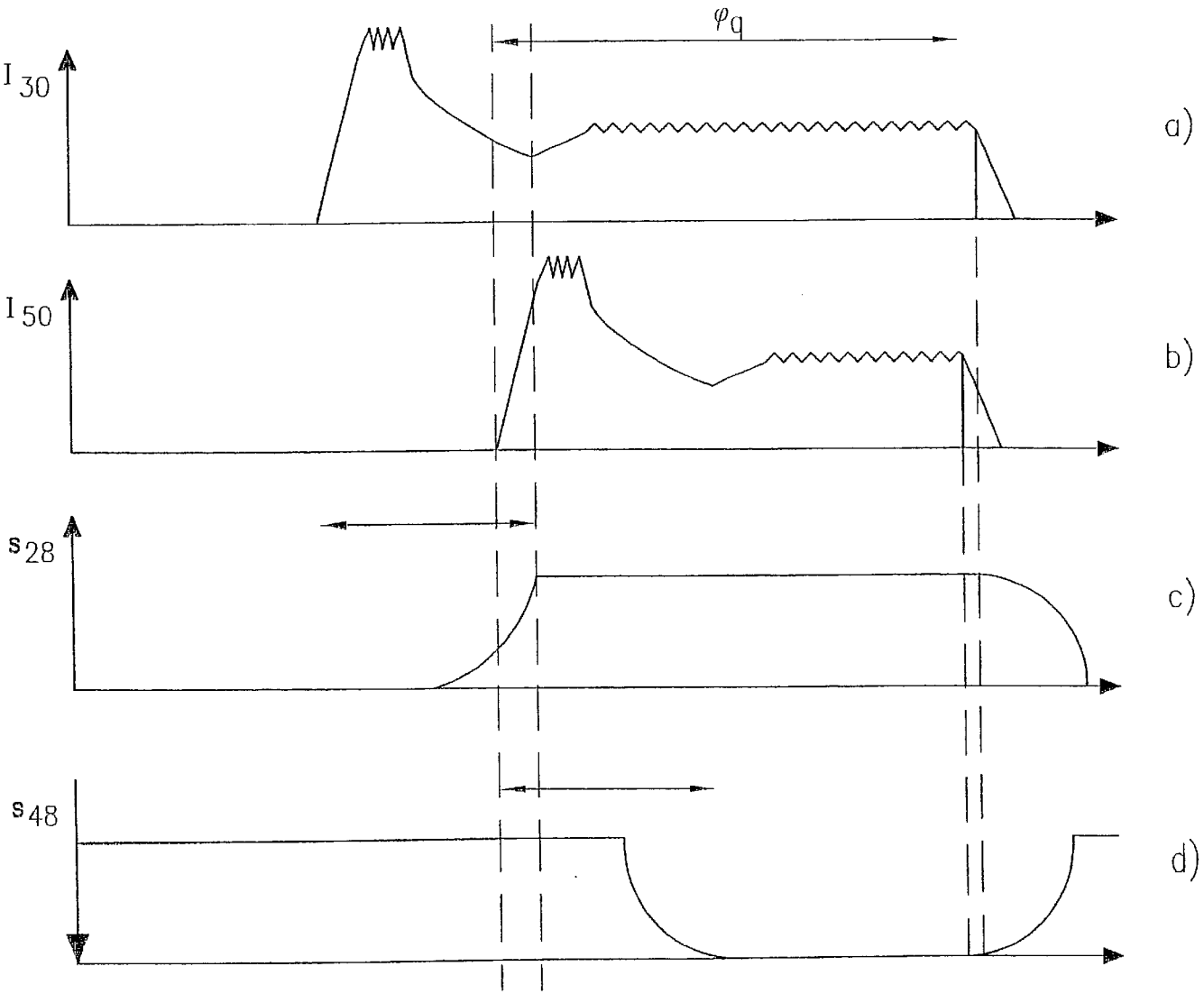
FIGS. 6*a*–6*d* are various graphs of characteristic variables that are relevant to the course of injection that is attainable with the injection system of the invention.

In FIG. 6*a*, the current through the final control element 30 is shown as a function of the angle of rotation of the crankshaft of the internal combustion engine that is to be supplied with fuel. In FIG. 6*b*, the current through the final control element 50 of the injection nozzle is shown as a function of the angle of crankshaft rotation. In FIG. 6*c*, the stroke of the control slide 28 is shown as a function of the angle of crankshaft rotation. Finally, in FIG. 6*d*, the stroke of the valve element 48 is shown as a function of the angle of crankshaft rotation.

It can be seen clearly from the graphs that the control of the valve element 48 can be done independently of the control of the control slide 28, so that the desired course of injection can be selected freely.

Figure 3:
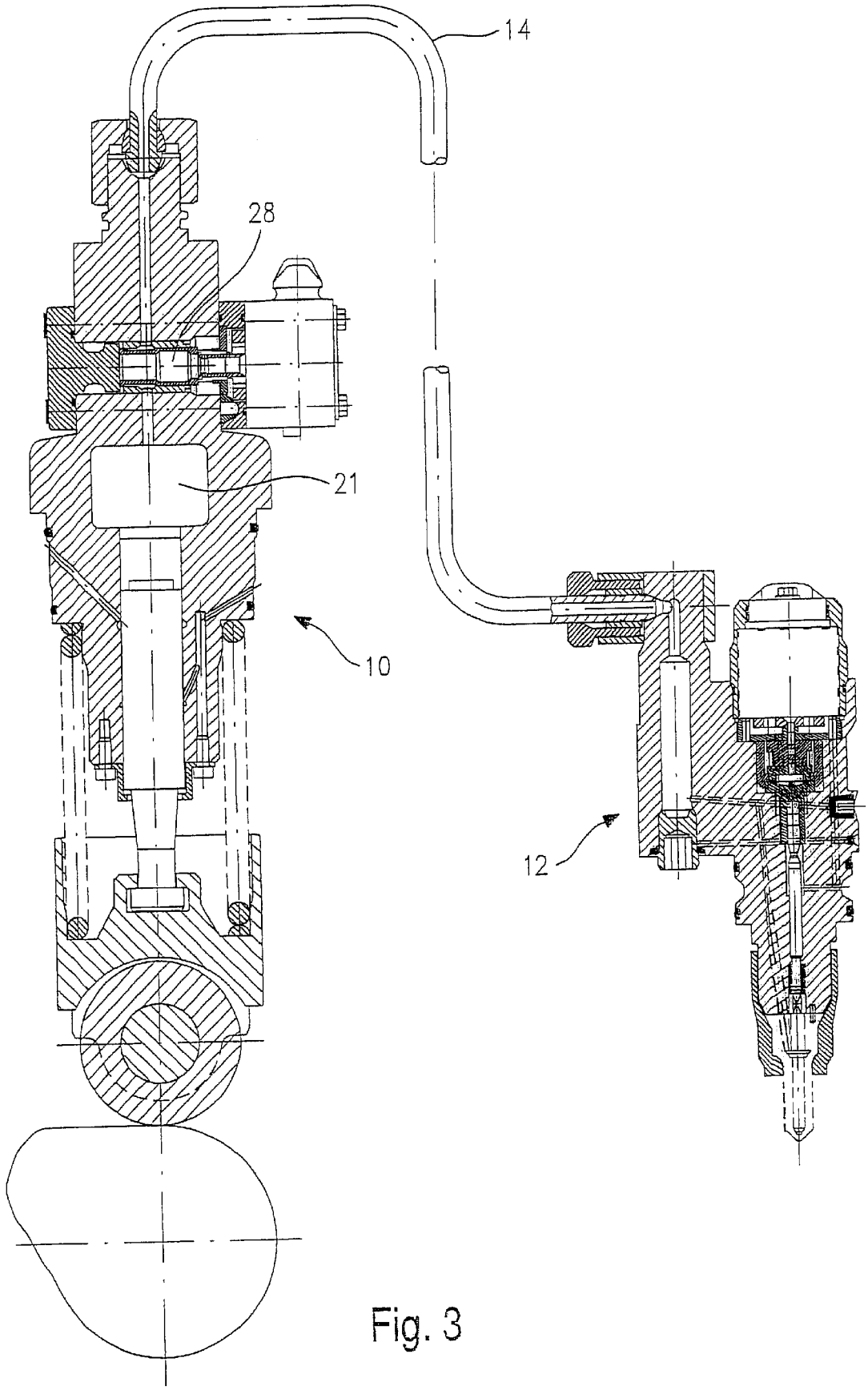
FIG. 3 is a view corresponding to that of FIG. 1 of an injection system in accordance with a second embodiment of the invention.

In FIG. 3, an injection system in accordance with a second embodiment is shown. It differs from the injection system shown in FIG. 1 in that a high-pressure collection chamber 21 is disposed in the interior of the fuel pump 10, between the pump piston 18 and the control slide 28. The high-pressure collection chamber 21 functions like a pressure reservoir, so that an even greater time lag between the onset of pumping by the fuel pump 10 and the opening of the nozzle needle 34 of the injection nozzle 12 is possible.

Figure 4:
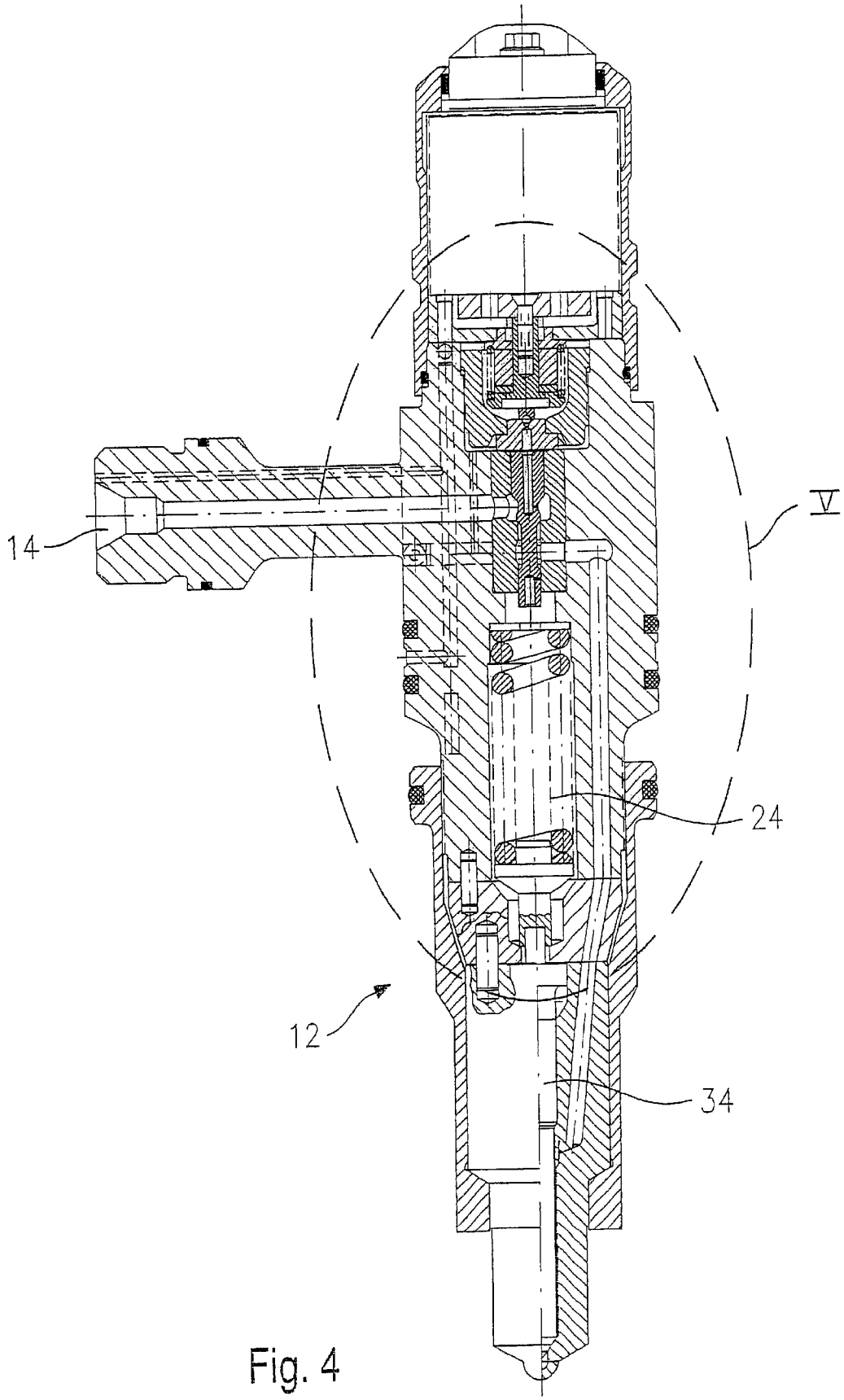
FIG. 4 is a sectional view of an injection nozzle which can be used in an injection system in accordance with a third embodiment of the invention.
Figure 5:
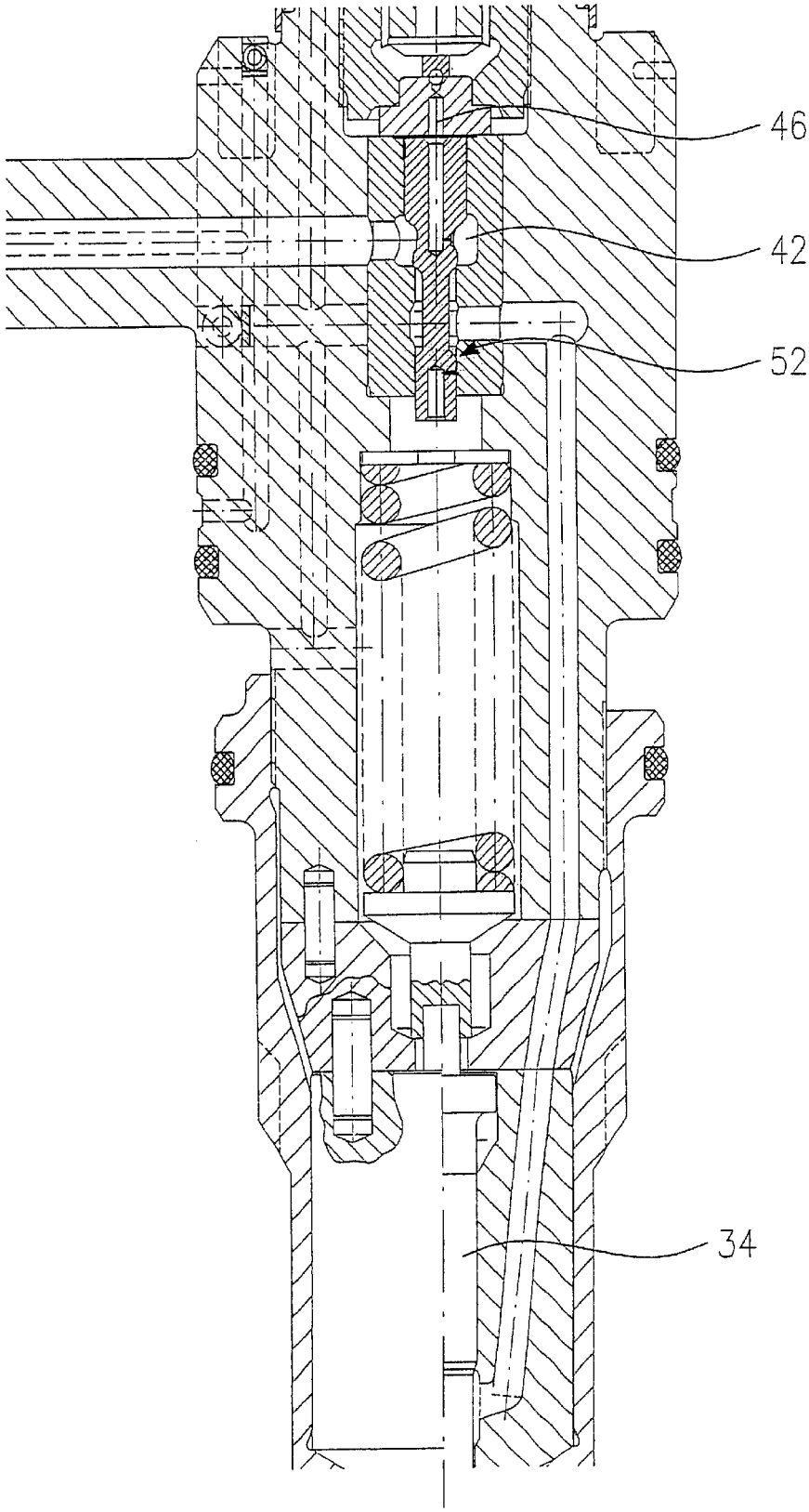
FIG. 5 shows detail V of FIG. 4, on a larger scale.

In FIGS. 4 and 5, an injection nozzle 12 for an injection system in a third embodiment is shown. Instead of the valve element 48, a valve slide 52 is used do here, forming a 3/2-way valve. Once again, an inlet throttle 42 and an outlet throttle 46 are provided, and the inlet to the nozzle needle 34 is opened upon the opening of the valve slide 52. In the closed state of the valve slide 52, the inlet to the nozzle needle 34 and the nozzle chamber overall are relieved by the valve slide 52 to the fuel return 24. The advantage of this embodiment is that the injection nozzle is subjected to the fuel pressure only during the injection.

The foregoing relates to a preferred exemplary embodiment of the invention, it being understood that other variants and embodiments thereof are possible within the spirit and scope of the invention, the latter being defined by the appended claims.

What is claimed is:

1. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said injection nozzle (12) is provided with a reservoir (13), in which a fluid can be dammed up by means of the electronically controlled valve (48, 50; 50, 52), so that the then operative pressure keeps the nozzle needle (34) in its closed position.

2. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said the fuel pump (10) is provided with an electronically controlled control slide (28) and wherein said injection nozzle (12) is provided with a reservoir (13), in which a fluid can be dammed up by means of the electronically controlled valve (48, 50; 50, 52), so that the then operative pressure keeps the nozzle needle (34) in its closed position.

3. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said fuel pump (10) is provided with a high-pressure chamber (21) and wherein said injection nozzle (12) is provided with a reservoir (13), in which a fluid can be dammed up by means of the electronically controlled valve (48, 50; 50, 52), so that the then operative pressure keeps the nozzle needle (34) in its closed position.

4. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said the fuel pump (10) is provided with an electronically controlled control slide (28), wherein said fuel pump (10) is provided with a high-pressure chamber (21) and wherein said injection nozzle (12) is provided with a reservoir (13), in which a fluid can be dammed up by means of the electronically controlled valve (48, 50; 50, 52), so that the then operative pressure keeps the nozzle needle (34) in its closed position.

5. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said electronically controlled valve of said injection nozzle is a 3/2-way valve, which is provided with a valve slide (52).

6. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said the fuel pump (10) is provided with an electronically controlled control slide (28) and wherein said electronically controlled valve of said injection nozzle is a 3/2-way valve, which is provided with a valve slide (52).

7. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said fuel pump (10) is provided with a high-pressure chamber (21) and wherein said electronically controlled valve of said injection nozzle is a 3/2-way valve, which is provided with a valve slide (52).

8. An injection system for an internal combustion engine comprising one electronically controlled fuel pump (10) per engine cylinder to be supplied, an injection nozzle (12) that is provided with a nozzle needle (34), and a connecting line (14) between the fuel pump (10) and the injection nozzle (12), said injection nozzle being provided with an electronically controlled valve (48, 50; 50, 52), which is capable of controlling the opening of the nozzle needle (34), wherein said the fuel pump (10) is provided with an electronically controlled control slide (28), wherein said fuel pump (10) is provided with a high-pressure chamber (21) and wherein said electronically controlled valve of said injection nozzle is a 3/2-way valve, which is provided with a valve slide (52).

* * * * *